US005187896A

United States Patent [19]

Ross

[11] Patent Number: 5,187,896

[45] Date of Patent: Feb. 23, 1993

[54] PIVOT ROD CONNECTOR FOR MOVEABLE SHUTTERS

[75] Inventor: Alan Ross, Ontario, Canada

[73] Assignee: Dominion Plastics Inc., Woodbridge, Canada

[21] Appl. No.: 859,652

[22] Filed: Mar. 30, 1992

[51] Int. Cl.[5] ..... E05F 17/00

[52] U.S. Cl. ..... 49/74.1; 49/87.1; 49/92.1

[58] Field of Search ..... 49/74 L, 77 DG, 79 MC, 49/87 HN, 92 SS; 454/278

[56] References Cited

U.S. PATENT DOCUMENTS

| | | | |
|---|---|---|---|
| 395,902 | 1/1889 | Heidt | 49/74 L |
| 456,306 | 7/1891 | Heidt | 49/87 HN |
| 1,340,252 | 5/1920 | Rasmussen | 49/74 L |
| 2,761,185 | 9/1956 | Sherwood | 49/74 L |
| 4,655,003 | 4/1987 | Henley | 49/74 LX |
| 4,996,793 | 3/1991 | Mazue | 49/74 L |
| 5,001,864 | 3/1991 | Truscott | 49/74 LX |

FOREIGN PATENT DOCUMENTS 6501514 8/1965 Netherlands .

*Primary Examiner*—Renee S. Luebke
*Assistant Examiner*—Jerry Redman

[57] ABSTRACT

A louvre control for operating moveable louvres of a window or door structure is connectable to a louvre having an undercut recess for receiving a connector on the control. The connector is normally set in a louvre connecting position, is moveable to a louvre recess insertion position and is biased to return to the louvre connecting position after it is inserted into the undercut recess of the louvre.

4 Claims, 4 Drawing Sheets

FIG. 4.
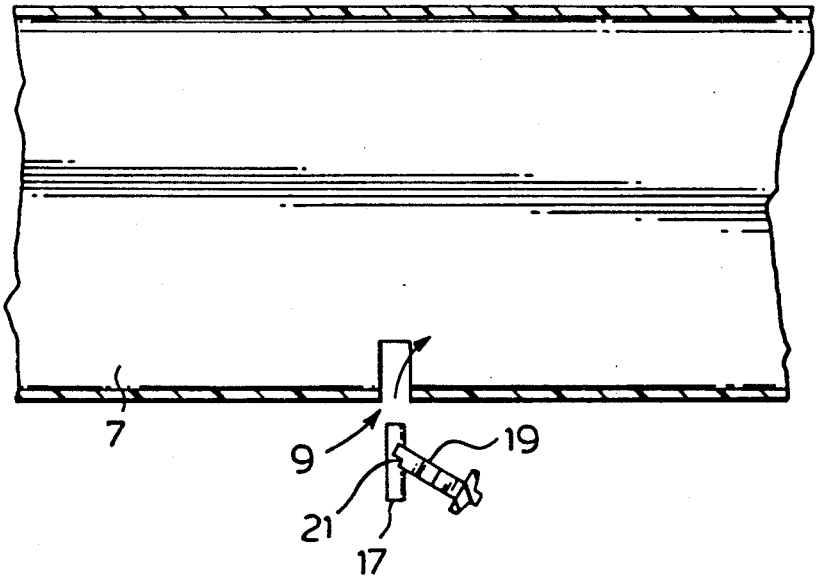
FIG. 5.
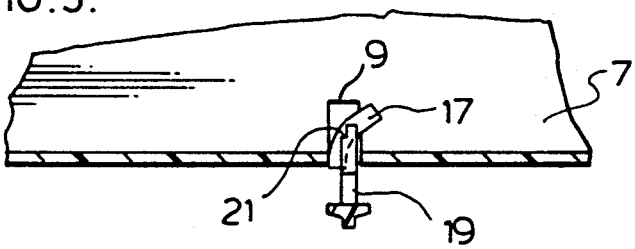
FIG. 6.
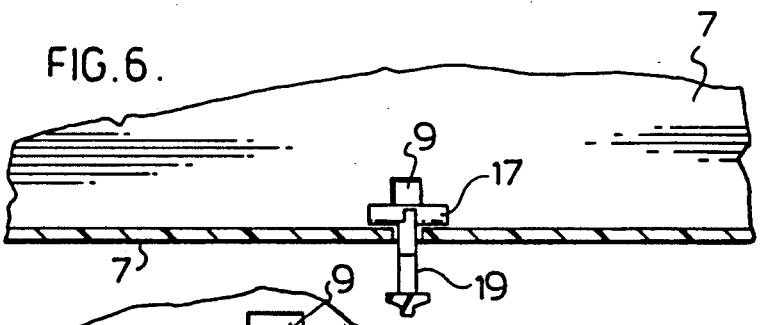
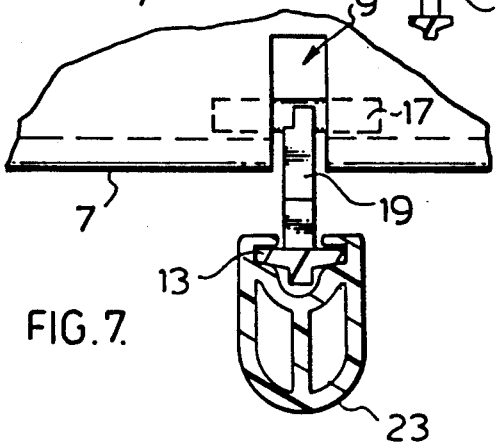
FIG. 7.

PIVOT ROD CONNECTOR FOR MOVEABLE SHUTTERS

FIELD OF THE INVENTION

The present invention relates to connectors of a control bar for connecting the control bar to a louvre movable within a window or door structure.

BACKGROUND OF THE INVENTION

Traditional movable louvre structures are made of wood. A control bar is used to move a plurality of louvres in unison with one another. The control bar is secured to the louvres by means of small staples embedded in the wood material forming the louvres.

The above arrangement is not feasible when working with plastic or vinyl shutters. Furthermore, even with a wooden shutter, the staples connecting the control bar to the shutters are often pulled out and difficult to reinsert in the wood, particularly by the home user of the shutter.

SUMMARY OF THE INVENTION

The present invention provides a much more positive means of connecting a control to a louvre movable within a louvre window or door structure. Specifically, a louvre control of the present invention includes a connector for connecting the control to a moveable louvre having an undercut recess for receiving the connector. The connector is normally set in a louvre connecting position, is moveable to a louver recess insertion position and is biased to return to the louvre connecting position after it has been fitted into the louvre.

The connector, once inserted in the louvre, will not pull out without either breaking or deliberately removing the connector.

BRIEF DESCRIPTION OF THE DRAWINGS

The above as well as other advantages and features of the present invention will be described in greater detail according to the preferred embodiments of the present invention in which:

FIGS. 4 through 6 show the different stages of insertion of one of the connectors of the control bar into one of the louvres in FIG. 3;

FIG. 7 is a sectional view looking down into the control bar and showing its connection with one of the louvres from the shutter of FIG. 1;

DETAILED DESCRIPTION OF THE PREFERRED EMBODIMENTS

Figure 1:
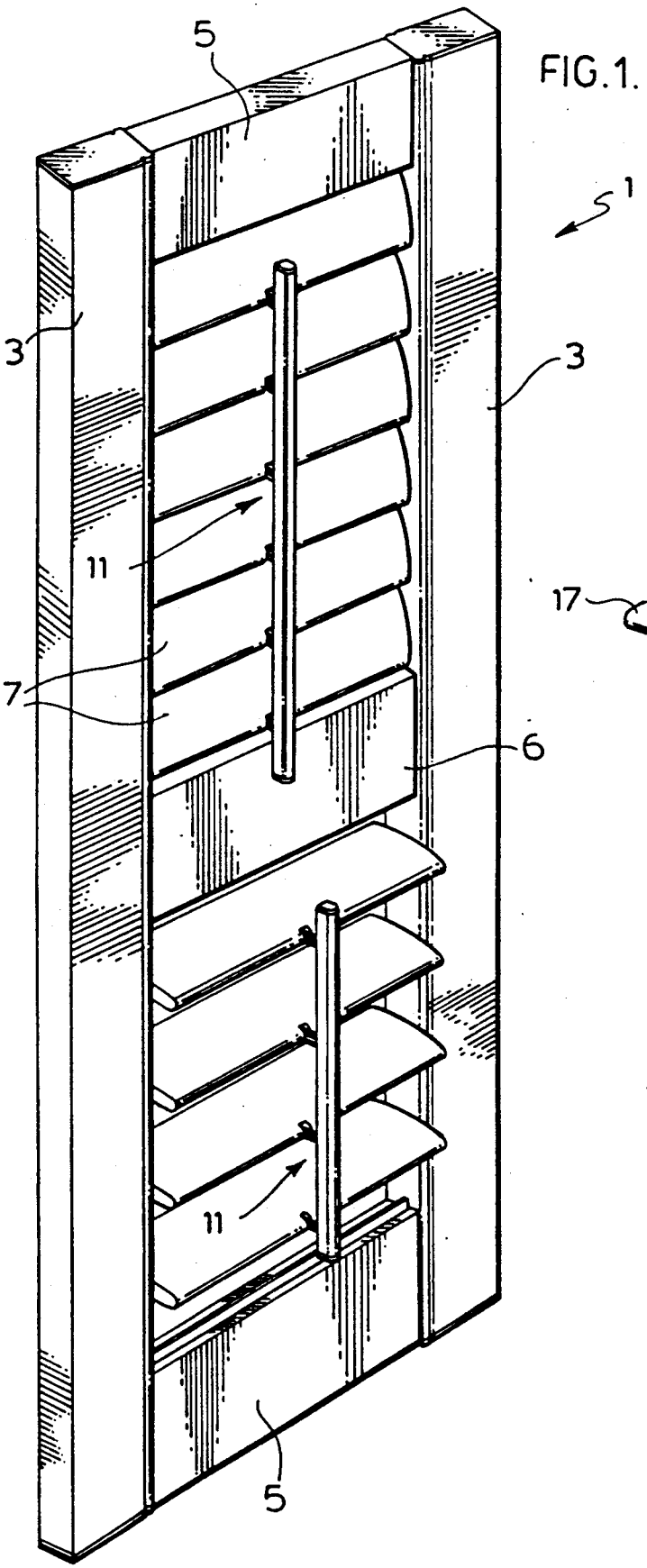
FIG. 1 is a perspective view of a shutter including a plurality of moveable louvres and a control bar connected to and operating the louvres in accordance with a preferred embodiment of the present invention.

FIG. 1 shows a louvred shutter generally indicated at 1 and preferably constructed from vinyl or some other similar type of resin material. This shutter is formed by an outside frame including styles 3 and opposite end headers 5. In this particular arrangement, a centre frame section 6 is also provided extending between the styles 3.

Trapped within the frame are a plurality of moveable louvres 7. Each of these louvres includes opposite end pins or axles which are rotationally secured within the styles and allowing pivotal movement of the louvres.

Figure 2:
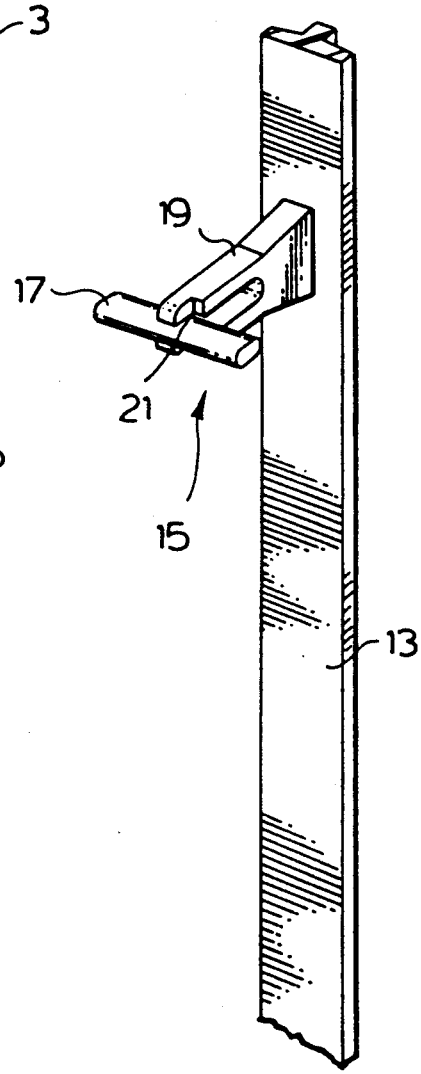
FIG. 2 is a bottom perspective view of part of the control bar shown in FIG. 1 of the drawings.
Figure 3:
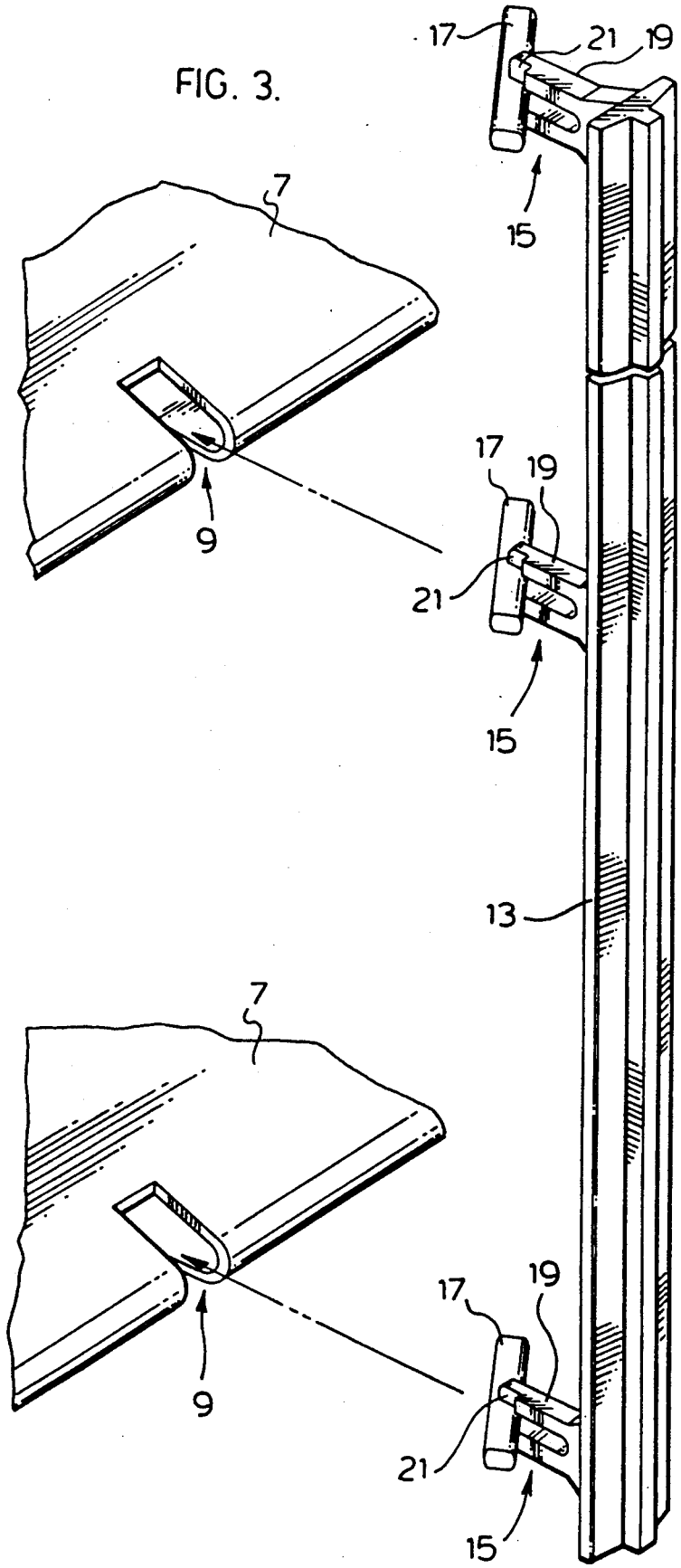
FIG. 3 is an enlarged perspective view showing set up for connecting of the control bar of FIG. 2 to a pair of louvres from the shutter of FIG. 1.

In the shutter shown in FIG. 1, the louvres are arranged in two groups, one above and one below the centre frame section 6. The louvres in each group are moveable in unison with one another by means of a control bar including bar member 11. The control bar includes a plurality of connectors generally indicated at 15 as best seen in FIGS. 2 and 3 of the drawings with each connector being secured to one of the individual louvres.

The louvres themselves as best seen in FIGS. 4 through 6 of the drawings have a hollow construction. Each louvre has an opening generally indicated at 9 centrally of its wing-like edge. This opening in combination with the hollow construction provides an undercut recess within the louvre. The undercut recess is used for connecting or trapping one of the connector members 15 as will be described later in greater detail.

Each connector 15 is formed by first and second connector portions 17 and 19. These two portions are molded as a common unit at a generally right angle as shown in FIGS. 6 and 7 of the drawings. Connector portion 19 includes a cut-out region 20 which in combination with a bendable plastic construction of the connector allows bending of connector portion 17 relative to connector portion 19 away from its molded configuration to a configuration where the two connector portions are much more in line with one another as shown in FIG. 4 of the drawings. This bending of connector portion 17 moves the overall connector from what will be referred to as a connecting position to an insertion position. When the connector is in the connecting position, it will not fit through the opening to the hollow interior of the louvre. However, by varying the angle between the two connector portions, i.e., by bending the first connector portion away from its right angle setting to a more in-line position with respect to the second connector portion, connector portion 17 is fittable through the louvre opening as shown in FIGS. 4 and 5 of the drawings. Once connector portion 17 is fitted within the louvre, the memory of the material causes it to move back to its molded connecting position of FIG. 3. In this position, the span across connector portion 17 is greater than the width across opening 9 which is the reason that connector portion 17 cannot be inserted into the opening without first bending it and which is also the reason that connector portion 17, once fitted through the opening, is trapped inside the louver.

The overall connector 15 is preferably constructed of polypropylene which has very positive characteristics to enhance operation of the connector. In particular, polypropylene, while being bendable without breaking, has a memory which causes it quickly to return to its molded form. Furthermore, it will take substantial abuse without damage or breaking.

Another feature of the connector is the provision of small cut away areas or recesses 21 in connector portion 19. The provision of recesses 21 eases the force required in order to align or substantially align the two connector portions with one another but does not detract from the memory of the material for returning to its premolded configuration.

Figure 8:
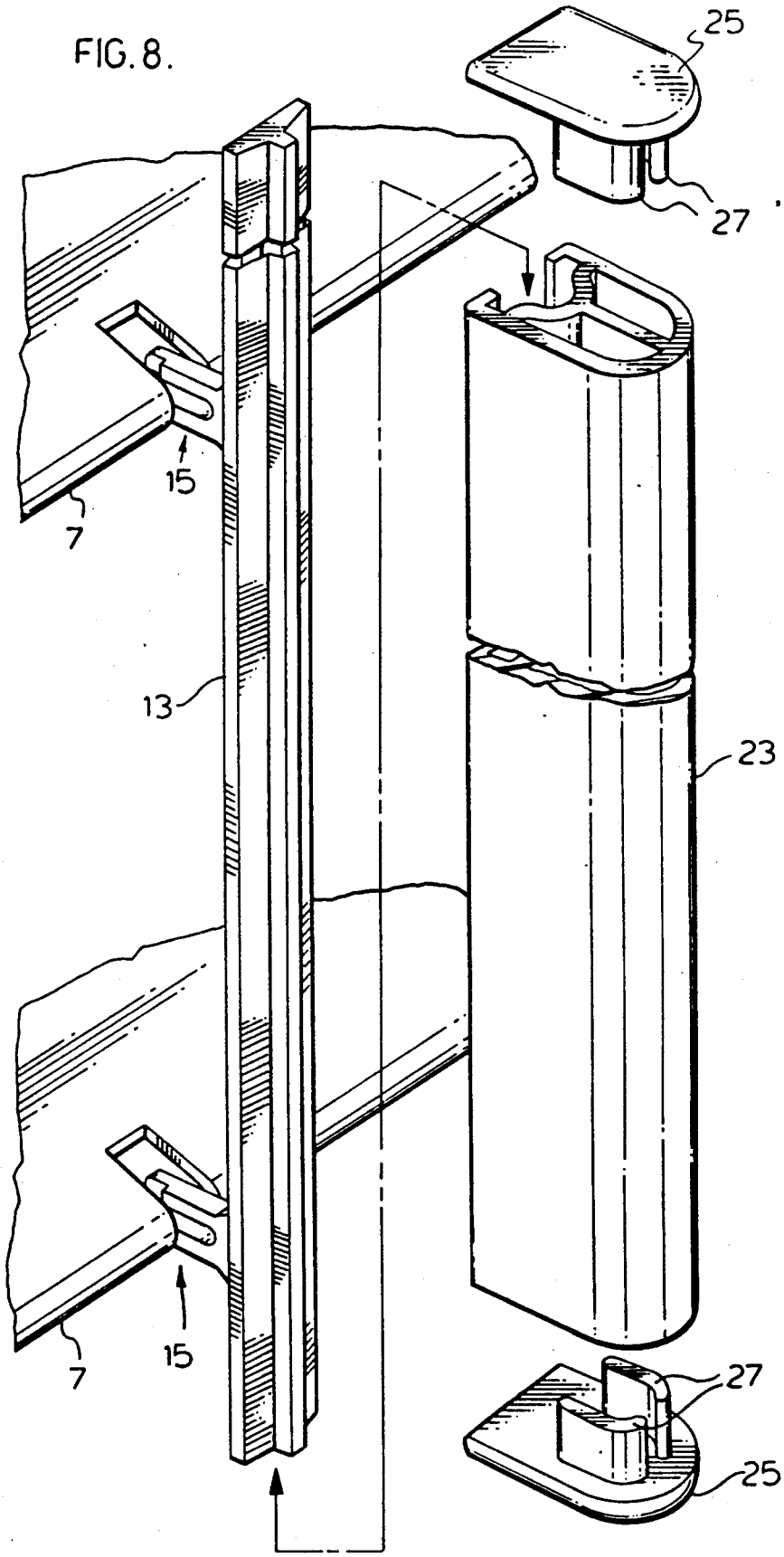
FIG. 8 is an enlarged partially exploded perspective view of a control bar connected to two shutters according to a preferred embodiment of the present invention.

The control bar itself has a multi-component construction best shown in FIG. 8 of the drawings. As was earlier noted, bar member 13 includes the actual connectors 15. Additionally provided is a sheath or cover 23 which includes an undercut recess 24 for sliding over and securing to bar member 13. The overall assembly is then completed by means of upper and lower end caps 25, each of which includes tabs 27 frictionally engaged within sheath 23.

In the event that bar member 13 or any of the connectors 15 are damaged, one simply has to remove one of the end caps 25, slide sheath 23 off of and replace bar member 13 while still being able to reuse the sheath and end caps. This provides an obvious cost benefit to the consumer if any of the connectors should happen to fail.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A louvre assembly comprising a louvre having a louvre recess and a louvre control bar with a connector attached to said louvre at said recess, said connector comprising first and second connector portions with said first connector portion being secured to said second connector portion and said second connector portion secured to said control bar, said connector portions normally assuming a connection position in which said first and second connector portions are out of alignment relative to one antoher to the extent that said second connector is not fittable into said louvre, said first connector being bendable to a louvre insertion position in which said first and second connector portions are at least generally in alignment with respect to one another and in which said first connector portion is fitted into said louvre while remaining secured to said second connector portion, said first connector being biased to return to said connecting position after fitting and trapping said second connector portion in said louvre recess thereby connecting said control bar to said louvre.

2. A louvre assembly as claimed in claim 1 wherein said connector is constructed from a plastic material having a memory for returning said connector to the connecting position.

3. A louvre assembly as claimed in claim 2 wherein said connector has a T-shape when in the connecting position.

4. A louvre assembly as claimed in claim 1 wherein said assembly includes a plurality of said louvres and said control bar includes a plurality of said connectors spaced lengthwise along said control bar attached to said louvres.

* * * * *